US008627621B2

(12) United States Patent
Liebscher et al.

(10) Patent No.: US 8,627,621 B2
(45) Date of Patent: Jan. 14, 2014

(54) ROLLER RAIL FOR A SLIDING DOOR AND METHOD FOR ACTUATING A TURNOUT IN A ROLLER RAIL

(75) Inventors: Arne Liebscher, Herdecke (DE); Olaf Lüttmann, Bad Zwischenahn (DE)

(73) Assignee: Dorma GmbH +Co. KG, Ennepetal (DE)

( * ) Notice: Subject to any disclaimer, the term of this patent is extended or adjusted under 35 U.S.C. 154(b) by 0 days.

(21) Appl. No.: 13/391,205

(22) PCT Filed: Aug. 3, 2010

(86) PCT No.: PCT/EP2010/004731

§ 371 (c)(1),
(2), (4) Date: Feb. 17, 2012

(87) PCT Pub. No.: WO2011/020557

PCT Pub. Date: Feb. 24, 2011

(65) Prior Publication Data

US 2012/0144627 A1 Jun. 14, 2012

(30) Foreign Application Priority Data

Aug. 20, 2009 (DE) ..... 10 2009 038 014

(51) Int. Cl.
*E04H 1/00* (2006.01)

(52) U.S. Cl.
USPC ..... 52/238.1; 52/29; 16/95 R; 16/96 R; 49/127

(58) Field of Classification Search
USPC ..... 52/238.1, 243, 29; 16/87 R, 91, 94 R, 16/95 R, 96 R, 87 B; 49/125, 127, 129; 104/130.01, 130.09; 160/200, 205
See application file for complete search history.

(56) References Cited

U.S. PATENT DOCUMENTS

| | | | | | |
|---|---|---|---|---|---|
| 2,121,696 | A | * | 6/1938 | Horn | 104/130.01 |
| 2,657,436 | A | * | 11/1953 | Fairhurst et al. | 52/64 |
| 3,052,000 | A | * | 9/1962 | Ferrett | 52/64 |
| 3,279,123 | A | * | 10/1966 | Genison | 49/127 |
| 5,230,123 | A | * | 7/1993 | Williams et al. | 16/95 R |
| 6,286,258 | B1 | * | 9/2001 | Bischof et al. | 49/127 |
| 6,848,214 | B2 | | 2/2005 | Bischof et al. | |

FOREIGN PATENT DOCUMENTS

| | | | | | |
|---|---|---|---|---|---|
| DE | 942 965 | | | 5/1956 | |
| DE | 10 24 580 | | | 11/2001 | |
| DE | 200 15 203 | | | 1/2002 | |
| DE | 20015203 | U1 | * | 1/2002 | E05D 15/10 |
| DE | 20015203 | | * | 2/2002 | E05D 15/10 |
| EP | 0 737 791 | | | 10/1996 | |
| EP | 737791 | A1 | * | 10/1996 | E05D 15/06 |
| FR | 954 042 | | | 12/1949 | |
| FR | 954042 | A | * | 12/1949 | E05D 15/06 |
| GB | 1 529 458 | | | 10/1978 | |

* cited by examiner

*Primary Examiner* — Brian Glessner
*Assistant Examiner* — Adam Barlow
(74) *Attorney, Agent, or Firm* — Cozen O'Connor

(57) ABSTRACT

A roller rail for a sliding wall, which includes several sliding wall elements, in which each sliding wall element is supported to be displaceable via in particular two carriages. The roller rail is connectable to a branching roller rail via a turnout which is switchable by the carriages. At least one carriage of a sliding wall element, for switching the turnout, takes up a position which is located outside the turnout.

10 Claims, 7 Drawing Sheets

ROLLER RAIL FOR A SLIDING DOOR AND METHOD FOR ACTUATING A TURNOUT IN A ROLLER RAIL

CROSS REFERENCE TO RELATED APPLICATIONS

This is a U.S. national stage of application No. PCT/EP2010/004731, filed on Aug. 3, 2010 priority is claimed on German Application No. 10 2009 038 014.0 filed Aug. 20, 2009, the contents of which are incorporated here by reference.

BACKGROUND OF THE INVENTION

1. Field of the Invention

The invention relates to a roller rail for a sliding wall and to a method for actuating a turnout in a roller rail according. The sliding wall comprises several individual sliding wall elements, wherein generally each sliding wall element has two carriages that engage in the roller rail. The sliding wall element is suspended from the roller rail and is displaceable in the roller rail via the carriages. With the intention to move the sliding wall elements, for example into a parking position, the roller rail may be connected to a branching roller rail or may be disconnected therefrom, which action is realized via a switchable turnout, which is actuated by each carriage.

2. Detailed Description of Prior Art

Such sliding wall elements, known as leaf elements of horizontal sliding walls and folding sliding walls, may be located in the parking position or the closed position. In the parking position, the sliding wall elements are lined up next to each other, as a leaf package in a parking track. In the closed position, the sliding wall elements are aligned along the rail path of the roller rail between terminal walls or columns, and separate an interior area from an exterior area.

If the sliding wall elements are to be moved into the parking position, a carriage of a sliding wall element is moved further along the roller rail, whereas the other carriage of the same sliding wall element is moved onto the branching roller rail. To this end, the roller rail and the branching roller rail are connected via a turnout.

A roller rail of this species is known from the document DE 100 24 580 A1, in which the turnout is actuated, when a carriage passes therethrough. In this case, the carriage, when passing the turnout, presses against the turnout and changes the travel path. As the turnout is likewise loaded by the weight of the sliding wall element acting upon the carriage, the carriage, when passing the turnout, is impinged by distinct switching and/or holding forces, whereby the travel resistance is increased for the carriage.

SUMMARY OF THE INVENTION

It is an object of the present invention to provide a roller rail for a sliding wall, which is inexpensive and easy to manufacture and in which the switching and/or holding forces are minimized or completely eliminated when the carriage passes the turnout. Thus a reliable mode of operation of the turnout should be guaranteed when the carriages pass therethrough.

A completely new actuating method of the turnout is proposed in the inventive roller rail. Switching the turnout is realized by at least one carriage of the sliding wall element, as long as said carriage is positioned outside the sweep area of the turnout. It is only thereafter that the carriage passes the already actuated turnout without switching forces and/or holding forces occurring in the turnout. Therefore, mechanical wear of carriages and turnout is minimized and a smooth coordinated movement of the carriage is guaranteed in the roller rail, respectively in the branching roller rail. According to one embodiment of the invention, switching the turnout by the carriage outside the sweep area of the turnout is possible in both directions.

Advantageously, the turnout is configured as a simple switching element disposed between the roller rail and the branching roller rail. The switching element is controlled by a switching mechanism, to which it is connected in a torque-proof manner. Outside the turnout area, the switching mechanism protrudes into the driving direction of the carriage. If the carriage moves on the roller rail or the branching roller rail before reaching the turnout area, the carriage displaces the switching mechanism, which in turn shifts the switching element between the roller rail and the branching roller rail. In this case, the forces required for switching the switching mechanism are reduced. In case of motor failure of a motor-driven carriage the sliding wall elements can be manually moved from the parking position into a closed position or vice versa.

In one embodiment, the switching mechanism comprises a movably supported pivoted lever. At least one switching member is attached to the pivoted lever that protrudes into the travel direction of the carriage and is actuated by the carriage. As the pivoted lever is connected, in a torque-proof manner, to the switching element representing the turnout, the switching element is always shifted when the switching member is actuated by the carriage.

Preferably, when the switching member is configured as a change lever. In this case, two such change levers are disposed at the pivoted lever, wherein one change lever moves the turnout in the direction of the roller rail and the other change lever moves the turnout into the direction of the branching roller rail. Each change lever is mobile in both travel directions of each carriage, such that the switching element can be actuated via the change lever both, when the carriage enters the parking position and when the carriage leaves the parking position of the sliding wall elements. Once the carriage has passed the change lever, the latter returns into a resting position and is then displaced again by the following carriage.

A particularly robust structural design of the switching mechanism is achieved, if the change lever is pre-loaded by a spring element for returning the lever into its resting position. When actuating the change lever, the carriage just needs to deploy the force which is required to overcome the spring force. As the spring force, for returning the change lever into its resting position, may be kept very low and the switching mechanism in turn is configured to be easily movable, the carriage only needs to develop minimum switching forces for switching the turnout.

Conveniently, four change levers are provided at the pivoted lever, wherein two change levers point in the direction of the roller rail and the other two change levers point in the direction of the branching roller rail. Thus respectively one pair of change levers is provided for the roller rail and one for the branching roller rail. A first change lever of each pair is moved by the carriage in its first travel direction, whereas a second change lever of each pair is activated by the carriage on its return path, namely in a second travel direction. This is advantageous in that the displacement direction of a sliding wall element can be changed at any time. Even if only a portion of the sliding wall has moved, for example in the direction of the parking position, the first carriage of the sliding wall element having passed the turnout in the direction of the branching roller rail and the second carriage of the same sliding wall element is still positioned in front of the turnout, the carriage located on the branching roller rail is able to immediately start moving in the opposite travel direction and to pass the turnout in the direction of the roller rail. The sliding wall elements are therefore very flexible in terms of displacement, and, in case of electrically operated sliding wall elements, likewise the control expense is considerably reduced, such that a simple control system can be used.

As the two pairs of change levers move the pivoted lever of the switching mechanism, to which they are movably connected, back and forth between two different conditions, it is imperative to ensure that the pivoted lever remains in the once switched position so that the turnout will keep its position. This is why the pivoted lever is non-positively pre-loaded so that the pivoted lever stays in both of its terminal positions in a stable way.

Advantageously, the pivoted lever is pre-loaded by a spring to adjust both terminal positions in a stable way. This spring presses the pivoted lever into its respective terminal position. When actuating the change lever, the carriage needs to overcome this spring force at the pivoted lever in order to move the pivoted lever from the first terminal position into the second terminal position. In this case, the pivoted lever, under the action of the spring force, automatically switches to the next terminal position, if the pivoted lever has approximately traveled half of the distance from the one terminal position to the second terminal position, wherein half of the distance is covered by displacing the corresponding change lever by the carriage. The switching force, to be developed by the carriage, is thereby optimized.

It is furthermore intended that the two carriages, moving a sliding wall element, have different identifiers in the shape of encodings. A switching member, corresponding to the encodings and being affixed to the switching mechanism, is switched by the different encodings. It is by the encodings that the switching member recognizes if the turnout is actuated by the first carriage or the second carriage of a sliding wall element.

Preferably, the identifiers of the carriages are mechanically encoded. One such mechanical encoding may be realized in that the identifier is configured as a tenon, disposed on the carriage and dimensioned such that it contacts the switching member. In a particular robust and simple form, the switching member is configured as a leaf spring which, at least partially, surrounds a rotating shaft. The rotating shaft connects the pivoted lever and the switching element in a torque-proof manner. As the leaf spring is likewise firmly connected to the rotating shaft, the switching procedure of a carriage is therefore transferred to the switching element, which serves as the turnout. In order to reach contact with the carriage, each end of the leaf spring either protrudes in the travel direction of the carriage on the roller rail or in the travel direction of the carriage on the branching roller rail. In terms of structure, a leaf spring is an actuator, which is very easy to manufacture and nevertheless has sufficient stability to transfer the switching forces to the switching element, which act upon the leaf spring.

In one embodiment, the mechanical encoding is a cam. Those cams, in the shape of prominences on the carriage, for example tenons, are disposed at different locations on the carriages, and they conform to the configuration of the switching member. In case of a leaf spring as the switching member, the cam is placed on the right hand side of the first carriage of a sliding wall element and on the left hand side of the second carriage of the same sliding wall element, or vice versa.

In addition, it is indicated that the switching member may be configured as a rotary disc, wherein two rotary discs are required for actuating the turnout. In this case, the first rotary disc is oriented in the direction of the roller rail, whereas the second rotary disc points in the direction of the branching roller rail. Both rotary discs are interconnected by an arm assembly and are actuated by the differently disposed cams of the two carriages of a sliding wall element.

One embodiment of the invention is a method for actuating a turnout in a roller rail for a sliding wall comprising several sliding wall elements. In this case, each sliding wall element is displaced in the roller rail by preferably two carriages, the sliding wall element being attached thereto and suspended therefrom. The roller rail may be connected to the branching roller rail via a turnout or may be separated therefrom. In this case, the turnout is actuated by a carriage. In order to reduce the switching forces and/or holding forces when passing the turnout, the turnout is switched by means of the carriage, prior to the carriage entering the turnout. Therefore, when passing the turnout, no switching forces and/or holding forces will occur, which allows the respective carriage to smoothly pass the turnout.

Preferably a leading carriage switches the turnout for a following carriage. As an alternative, a carriage switches the turnout prior to the same carriage entering the turnout area. It is likewise conceivable that one carriage of the sliding wall element is provided with a drive and another one without a drive for automatically moving respectively displacing the sliding wall element. Likewise, one sliding wall element may have more than one or two carriages.

The technical features disclosed for the inventive device are likewise applicable to the inventive method and vice versa. Also, the inventive method may be realized with the inventive device.

BRIEF DESCRIPTION OF THE DRAWINGS

Further measures and advantages of the invention will result from the claims, the following description and the drawings. The invention is illustrated in the drawings in several embodiments, in which:

DETAILED DESCRIPTION OF THE PREFERRED EMBODIMENTS

Figure 1:
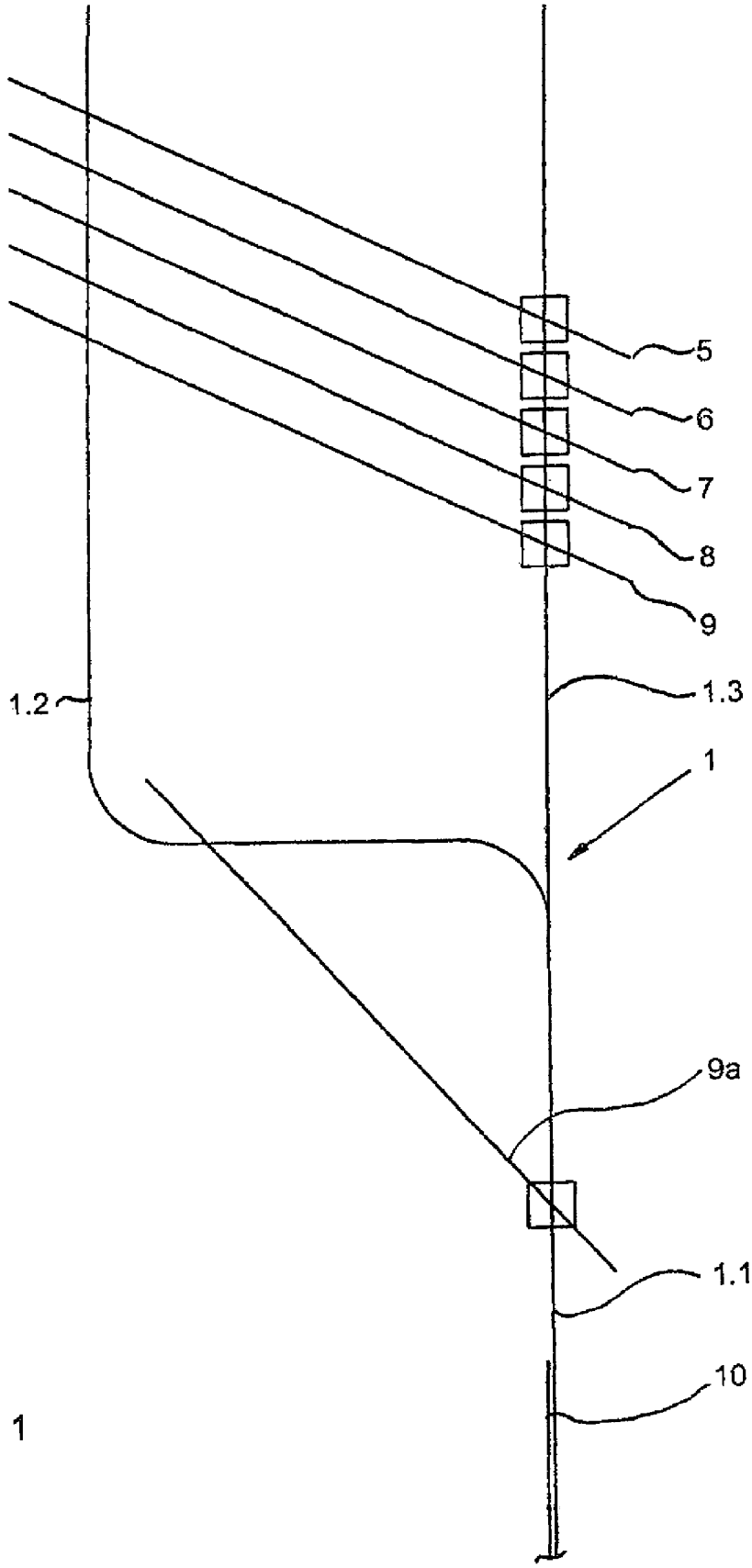
FIG. 1: is a diagrammatical illustration of the turnout in a system with a roller rail and branching roller rail.

In FIG. 1, a roller rail 1.1 is diagrammatically illustrated, which is fastened to the ceiling of a room and which, after a turnout 1, is split into a branching roller rail 1.2 and a roller rail section 1.3, wherein the roller rail section 1.3 represents an elongation of the roller rail 1.1. The sliding wall elements 5, 6, 7, 8, 9, which are in particular automatically displaceable, are represented to be suspended from two non-illustrated carriages in the branching roller rail 1.2 and in the roller rail section 1.3 in their parking position. In this case, the sliding wall elements 5, 6, 7, 8, 9 are lined up, upright and parallel to each other, wherein the first carriage of a sliding wall element is located on the branching roller rail and the second carriage of the sliding wall element is located on the roller rail section 1.3. As can be seen in FIG. 1, the sliding wall element 9 is in its parking position. Another position of the sliding wall element is identified by the reference numeral 9*a*. In this case, at first the one end of the sliding wall element 9*a* passes the turnout 1, which end was parked on the roller rail section 1.3, and turns onto the roller rail 1.1. Subsequently, the second end of the sliding wall element 9*a* follows, which was disposed on the branching roller rail 1.2. Both ends of the sliding wall element 9*a*, i.e. both carriages, now turn onto the roller rail 1.1, on which the sliding wall element 10 with both its carriages is already located.

Figure 2:
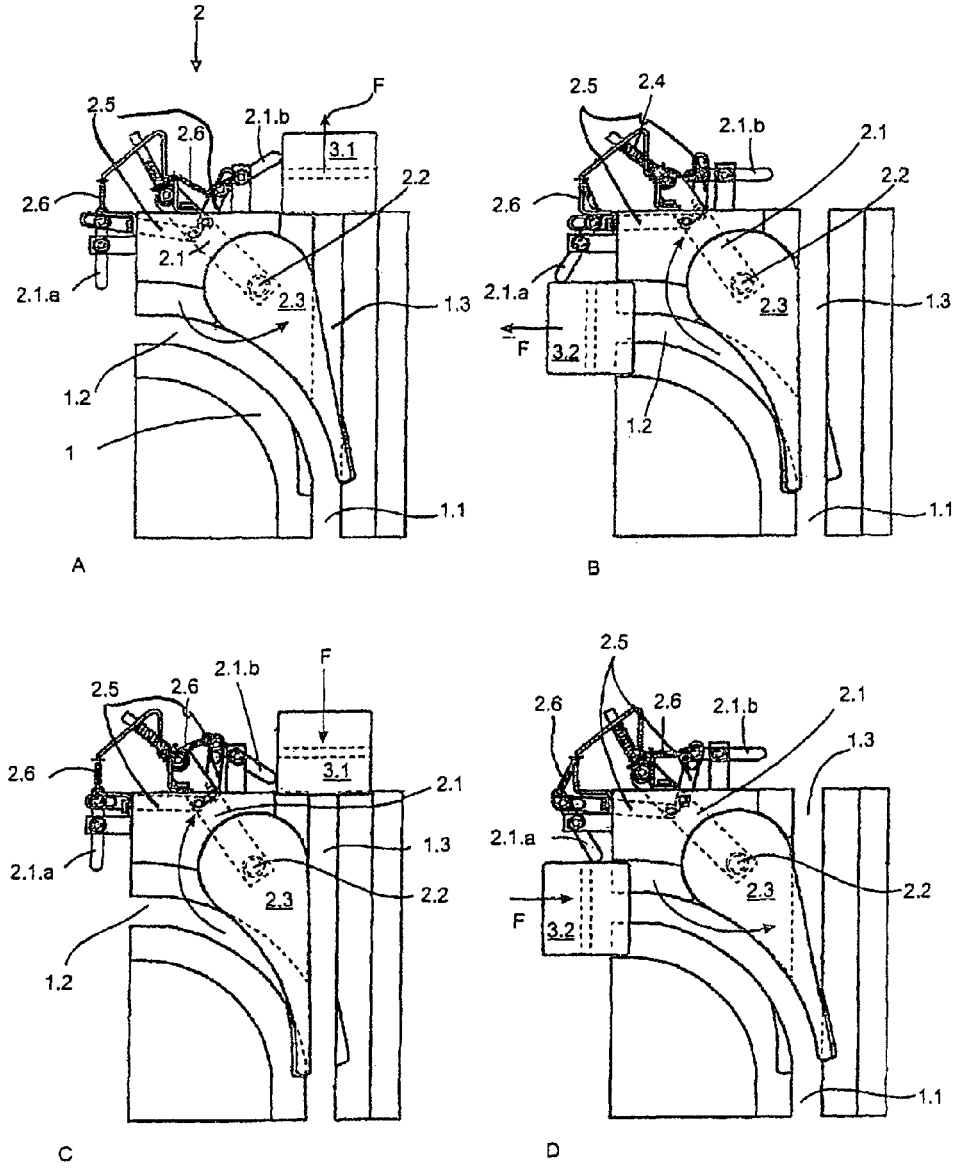
FIGS. 2A-2D: are diagrammatical illustrations of the switching mechanism for the turnout including one change lever per roller rail and branching roller rail.

In a first embodiment of the inventive roller rail, FIG. 2 shows the turnout 1 being switched by the carriages 3.1, 3.2. The roller rail 1.1, respectively the roller rail section 1.3 and the branching roller rail 1.2 are located in the area of the turnout 1. A switching mechanism 2, which includes a pivoted lever 2.1, is attached to the ceiling or to a covering of the roller rail 1.1, which lever is connected to a switching element 2.3 via a rotating shaft 2.2 in a torque-proof manner, which element unblocks or blocks the travel path of the carriages 3.1, 3.2 in the direction of the roller rail 1.1, respectively the roller rail section 1.3 or in the direction of the branching roller rail 1.2. A first change lever 2.1.*a* is disposed at the pivoted lever 2.1 in the direction of the branching roller rail 1.2, and a second change lever 2.1.*b* is disposed in the direction of the roller rail section 1.3. The attachment to the pivoted lever 2.1 is realized by an intermediate arm assembly 2.5, wherein a spring element 2.6 is disposed at each end of the intermediate arm assembly 2.5. Each spring element 2.6 is connected to respectively one change lever 2.1.*a* and 2.1.*b*, wherein the spring element 2.6 pulls each switching element, after the actuation is completed, into a resting position.

FIGS. A and B of FIG. 2 illustrate the switching procedure of the turnout 1, when the sliding wall elements 5, 6, 7, 8, 9, and 10 travel from the closed position into the parking position. A single sliding wall element is considered, which has the two carriages 3.1, 3.2, wherein for example the one carriage is configured without an electrical drive and the other carriage is configured with an electrical drive and moves the first carriage along, respectively displaces it. However, another variant is possible in that a driven carriage pulls the second carriage.

FIG. 2A shows the first carriage 3.1, the travel direction thereof being indicated by the arrow F, which, coming from the roller rail 1.1, has already passed the turnout 1, and now actuates the change lever 2.1.*b*, which protrudes into the travel path of the former. Shifting the change lever 2.1.*b* moves the pivoted lever 2.1 and pivots the switching element 2.3 in the counter-clockwise direction, whereby the roller rail section 1.3 is blocked. At this time, the change lever 2.1.*a* is in its resting position.

On account of this rest position of the switching element 2.3, the now following carriage 3.2 is directed into the direction of the branching roller rail 1.2, which can be seen in FIG. 2B. While turning into the branching roller rail 1.2, the second carriage 3.2 actuates the change lever 2.1.*a* out of its resting position, whereby the pivoted lever 2.1 is moved again and moves the switching element 2.3 via the rotating shaft 2.2 which operates as a shaft. Said element thus moves in the opposite direction, i.e. clockwise, and blocks the branching roller rail 1.2 for the following first carriage 3.1 of the next sliding wall element, which carriage is now moved again into the direction of the roller rail section 1.3.

The FIGS. 2C and 2D reveal the mode of operation of the switching mechanism 2, when moving the sliding wall elements 5, 6, 7, 8, 9, 10 from the parking position into the closed position. In FIG. 2C, initially the first carriage 3.1 of a sliding wall element 5, 6, 7, 8, 9, and 10 is moved, wherein the change lever 2.1.*b* is moved out of its resting position, whereby the switching element 2.3 is rotated clockwise and unblocks the path from the roller rail section 1.3 to the roller rail 1.1 and blocks the branching roller rail 1.2. During this operation, the change lever 2.1.*a* is located in its resting position. Once the first carriage 3.1 has 1.0 passed the turnout 1, the carriage 3.2, parked in the branching roller rail 1.2, moves the change lever 2.1.*a* with the result that the switching element 2.3 is rotated again in a counter-clockwise direction and unblocks the branching roller rail 1.2 so the carriage 3.2 can pass and travel into the roller rail 1.1 (FIG. 2D).

In this embodiment, a single change lever 2.1.*a* and 2.1.*b* is conveniently sufficient per individual rail 1.1 and 1.2.

FIG. 3 illustrates a second embodiment of the invention, in which a pair of change levers per roller rail are disposed at the pivoted lever 2.1. Thus the change levers 2.1.*a*.1 and 2.1.*a*.2 are associated with the roller rail section 1.3, whereas the change levers 2.1.*b*.1 and 2.1.*b*.2 are associated with the branching roller rail. The two pairs of change levers 2.1.*a*.1, 2.1.*a*.2 and 2.1.*b*.1, 2.1.*b*.2 are each connected to the pivoted lever 2.1 via an arm assembly 2.5.*a*, respectively 2.5.*b*, wherein the pivoted lever 2.1, at the end opposite the rotating shaft 2.2, is connected to a spring 2.4, which is configured as a compression spring. The spring 2.4 has the function of ensuring that the pivoted lever has only two stable terminal conditions, which match the two different positions of the switching element 2.3.

Figure 3B:
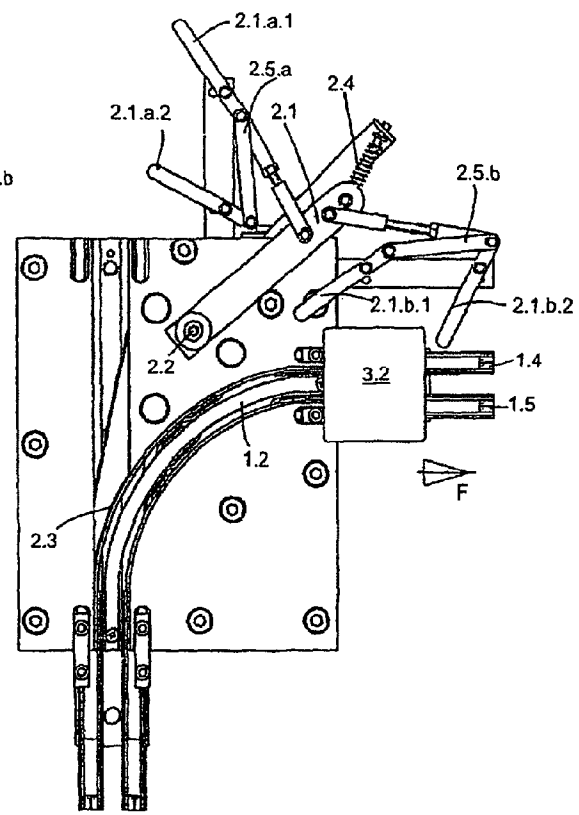
FIGS. 3A-3D: are diagrammatical illustrations of the switching mechanism for the turnout including one pair of change levers per roller rail and branching roller rail.
Figure 3A:
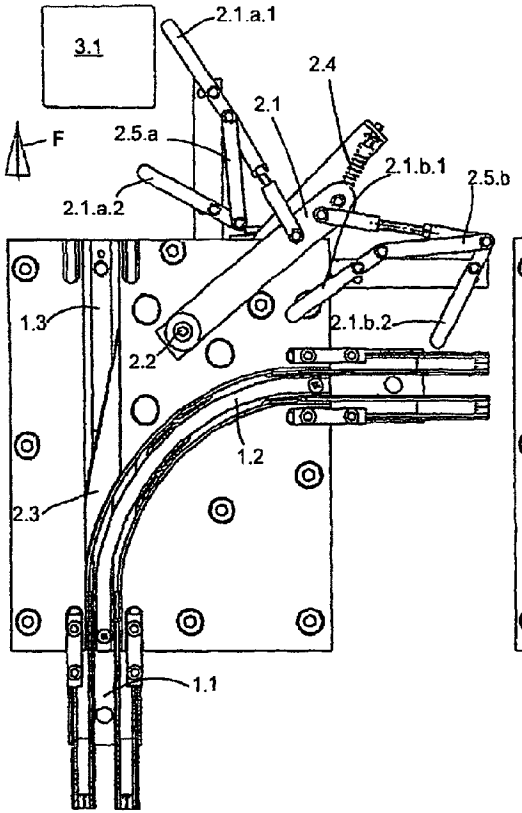

FIG. 3A shows the parking operation of a sliding wall element 5, 6, 7, 8, 9, and 10. In this case, the first carriage 3.1 has already passed the turnout 1 and, while continuing to travel in the roller rail section 1.3, actuates the change lever 2.1.*a*.1, whereby the switching element 2.3 unblocks the branching roller rail 1.2 for the following carriage 3.2 and blocks the roller rail section 1.3. In FIG. 3B, the second carriage 3.2 has passed the turnout 1 and turned onto the branching roller rail 1.2 and is positioned just before to actuating the change lever 2.1.*b*.2, which then again moves the switching element 2.3 to such a position that the branching roller rail 1.2 is blocked and the roller rail section 1.3 is unblocked for the first carriage 3.1 of the following sliding wall element.

Figure 3D:
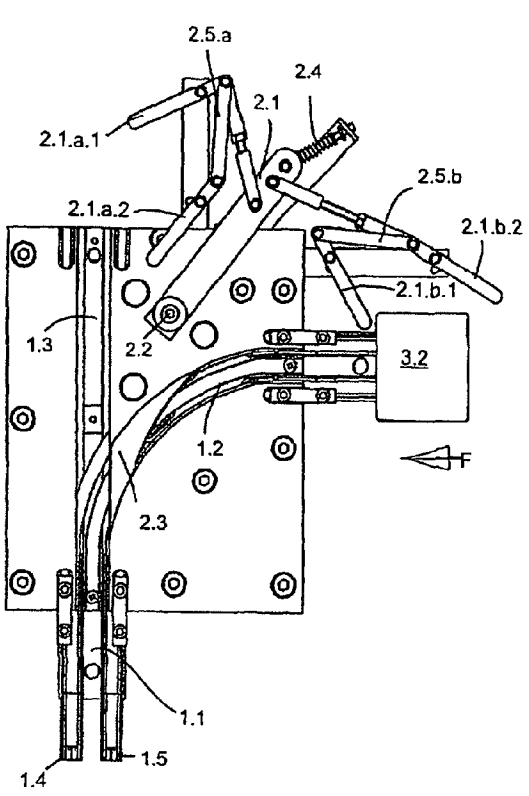
Figure 3C:
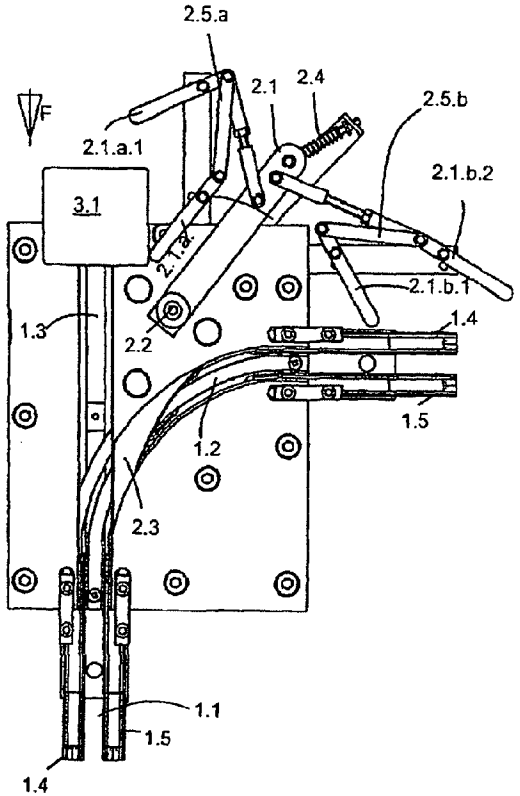

FIG. 3C illustrates the sliding wall elements 5, 6, 7, 8, 9, and 10 leaving the parking position. When leaving the parking position, the first carriage 3.1 of a sliding wall element initially moves the change lever 2.1.*a*.2, which, outside the turnout area, protrudes into the travel path thereof. The pivoted lever 2.1 is thereby moved from its first terminal position into its second terminal position and the switching element 2.3 unblocks the roller rail 1.1 for the carriage 3.1, which can pass the turnout 1 unhindered. In a next step, the second carriage 3.2 of the same sliding wall element parked on the branching roller rail 1.2, is displaced. In FIG. 3D, the second carriage 3.2 is just about to actuate the change lever 2.1.*b*.1. In this position, the switching element 2.3 still blocks the branching roller rail 1.2, which will be unblocked by actuating the change lever 2.1.*b*.2, whereby the switching element 2.3 is pivoted in the direction of the roller rail section 1.3 and unblocks the path for the carriage 3.2 from the branching roller rail 2.1 to the roller rail 1.1.

As already explained, the second carriage 3.2 may be driven electrically. For this purpose, a first power rail 1.4 and a second power rail 1.5, which contact the second carriage 3.2 and thereby supply electrical current, are disposed in the roller rail 1.1 and the branching roller rail 1.2.

Figure 4:
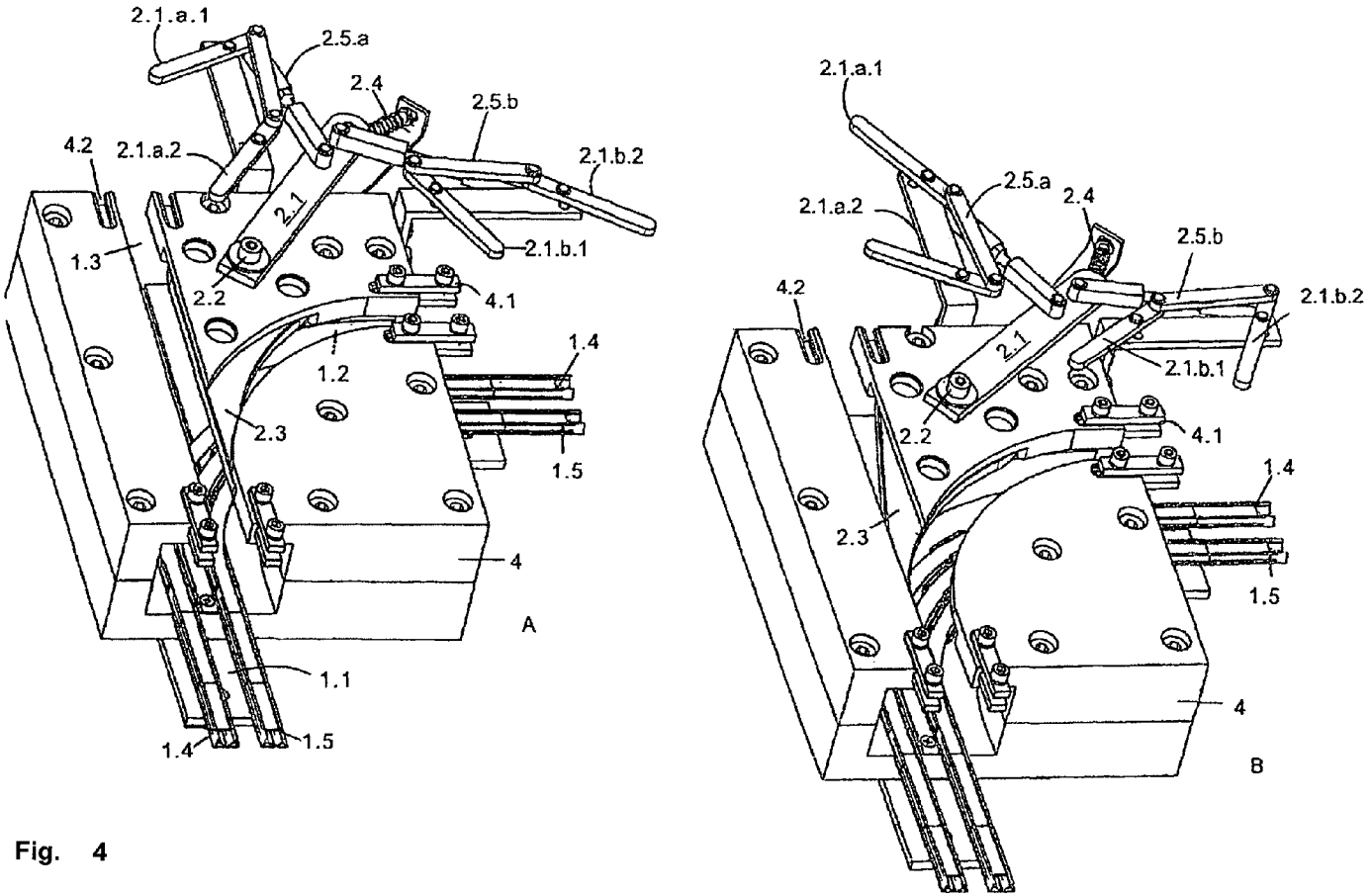
FIGS. 4A-4B: are three-dimensional illustrations of the switching mechanism at the exposed roller rail and branching roller rail.

FIG. 4 illustrates the covered turnout area of the roller rail according to the embodiment of FIG. 3. FIG. 4A shows the pairs of change levers 2.1.*a*.1, 2.1.*a*.2 and 2.1.*b*.1, 2.1.*b*.2 in the position in which the switching element 2.3 has separated the connection between the roller rail 1.1 and the roller rail section 1.3. FIG. 4B illustrates the pairs of change levers 2.1.*a*.1, 2 2.1.*a*.2 and 2.1.*b*.1, 2.1.*b*.2 in the position in which the switching element 2.3 has cleared the connection between the roller rail 1.1 and the roller rail section 1.3 and blocked the access to the branching roller rail 1.2.

The turnout area is provided with a cover 4, which is mechanically connected to the turnout 1 via connecting elements 4.1 and are configured as clamping elements. The cover 4 has mounts 4.2 into which the connecting element 4.1 is inserted.

Figure 5:
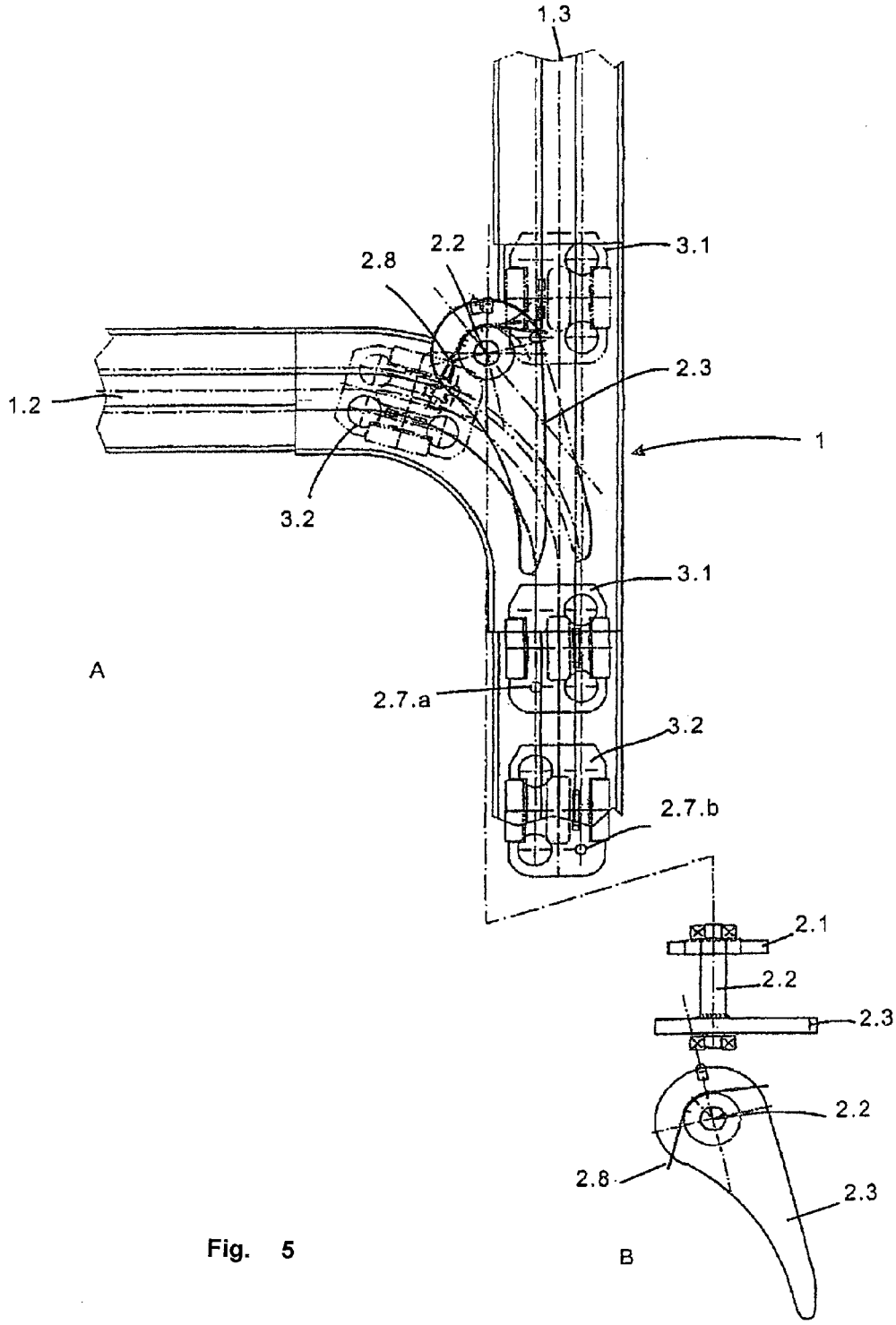
FIG. 5: is a diagrammatical illustration of the switching mechanism including a leaf spring as a switching member.

FIG. 5 shows a third embodiment of the invention. In this case, the carriages 3.1 and 3.2 are mechanically encoded by a cam 2.7.*a* and 2.7.*b*. Cam 2.7.*a* is a tenon, which is affixed to the carriage 3.1 on the outer rear left side thereof, whereas the cam 2.7.*b* is disposed at the second carriage 3.2 on the rear right side, again on the outside (FIG. 5A). If the carriage 3.1 passes the area of the turnout 1, the carriage, by the cam 2.7.*a*, actuates outside the turnout 1 an end of a leaf spring 2.8, which projects into the travel path of the carriage 3.1. As can be seen in FIG. 5B, the leaf spring 2.8 is partially bent around the rotating shaft 2.2. and is firmly connected to the latter. In this case, the leaf spring 2.8 forms a firm unit with the pivoted lever 2.1 and the switching element 2.3, which are likewise interconnected via the rotating shaft 2.2 in a torque-proof manner. When actuated by a carriage 3.1, 3.2, the leaf spring 2.8 is thus able to change the position of the switching element 2.3. The switching element 2.3 thus blocks the roller rail 1.3 after the first carriage 3.1 has passed the turnout 1 and, with its left cam 2.7.*a*, has actuated the leaf spring 2.8. The path in the direction of the branching roller rail 1.2 for the second carriage 3.2 of the same sliding wall element 5, 6, 7, 8, 9, and 10 is thus clear. Once the second carriage 3.2 as well has passed the turnout 1, it actuates the leaf spring 2.8, whereby the switching element 2.3 is set so that the following first carriage 3.1 of the next sliding wall element 5, 6, 7, 8, 9, and 10 can pass the turnout 1 unhindered.

When leaving the parking position, the second carriage 3.2 at first moves from the branching roller rail 1.2 into the roller rail 1.1, whereby, prior to passing the turnout 1, with its cam 2.7.*b*, it pushes the leaf spring 2.8 forward and thereby moves the switching element 2.3 into a position in which the switching element 2.3 unblocks the branching roller rail 1.2 and blocks the roller rail section 1.3. Once the carriage 3.2 reaches the roller rail 1.1, the carriage 3.2 drags the carriage 3.1 along which, with its cam 2.7.*b*, at first moves the spring leaf 2.8 forward in travel direction. The switching element 2.3 is thereby again switched and unblocks the path to the roller rail 1.1 for the carriage 3.1.

Figure 6:
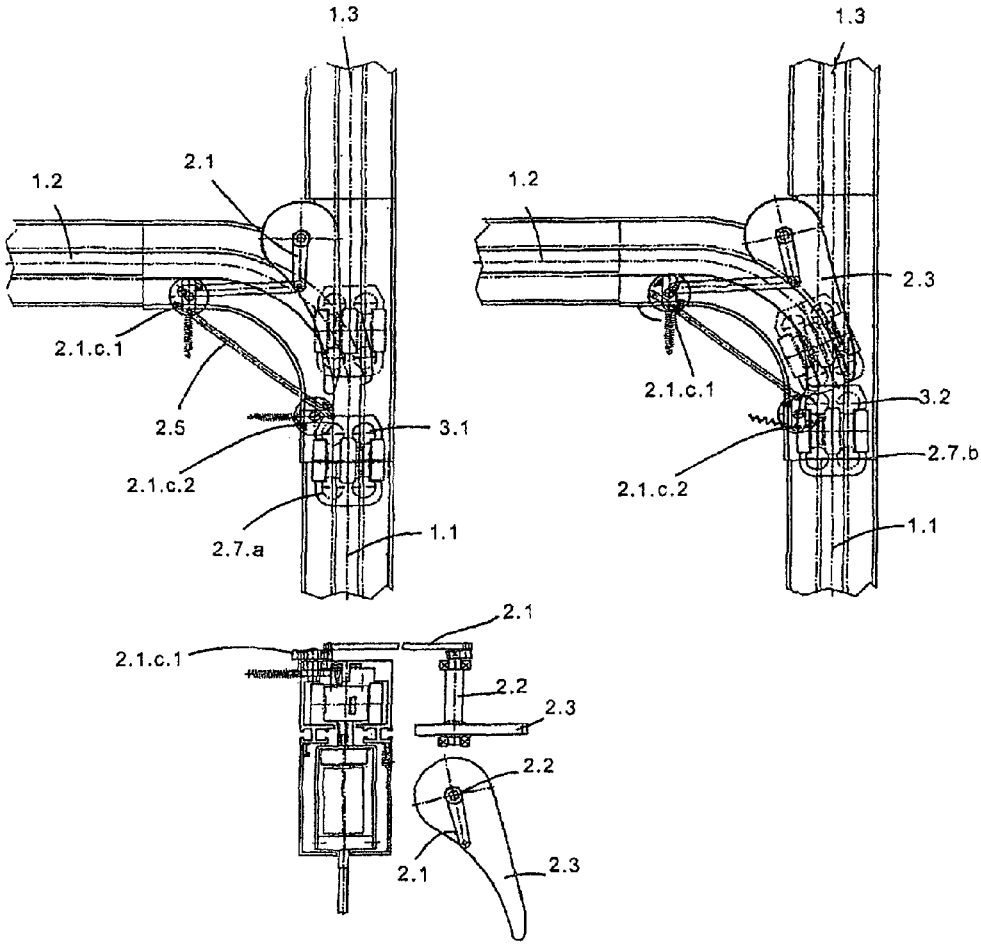
FIG. 6: is a diagrammatical illustration of the switching mechanism including a rotary disc as a switching member.

A fourth embodiment is illustrated in FIG. 6, in which one respective rotary disc 2.1.*c*.1 and 2.1.*c*.2 is associated to the branching roller rail 1.2 and the roller rail section 1.3. In this case again, the carriages 3.1. and 3.2 have mechanical cams 2.7.*a* respectively 2.7.*b*, which actuate a non-illustrated driver lug on the rotary disc 2.1.*c*.1, 2.1.*c*.2, which lug in turn moves a pivoted lever 2.1 at the switching mechanism 2 for actuating the switching element 2.3. The rotary discs 2.1.*c*.1 and 2.1.*c*.2 are coupled to each other via an arm assembly 2.5. When actuating the rotary disc 2.1.*c*1 clockwise, the arm assembly 2.5 has the task of moving the second rotary disc 2.1.*c*.2 counter-clockwise, whereby the driver lug of the second rotary disc 2.1.*c*.2 is placed in such a position that it is able to contact the cam 2.7.*b* of the following carriage 3.2.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A roller rail assembly for a sliding wall, having several sliding wall elements, each sliding wall element supported to be displaceable via two carriages, comprising:

a roller rail;

a branching roller rail; and a turnout that connects the roller rail to the branching roller rail that is switchable by the carriages, wherein, for switching the turnout, at least one carriage of a sliding wall element takes up a position located outside the turnout, wherein the turnout is a switching element connected to a switching mechanism that at least partially protrudes in the travel direction of the carriage travelling on at least one of the roller rail and the branching roller rail, wherein the switching mechanism is actuated by the carriage, whereby the switching element affixed to the switching mechanism moves between the roller rail and the branching roller rail, wherein the switching mechanism has a displaceably supported pivoted lever, which is connected to the switching element and to which at least one switching member is attached to be actuated by the carriage, wherein the pivoted lever has a first switching member pointing towards the roller rail, of the branching roller rail and configured as a change lever, the change lever configured to return to a rest position after being displaced by the carriage, wherein the change lever is biased by a spring element to returns to the rest position, wherein, for each of the roller rail and the branching roller rail, two respective switching members are disposed at the pivoted lever, the members are configured as change levers that point into the direction of their respective rail, wherein a first change lever associated to each rail can be actuated in a first direction of movement of the carriage by the carriage, and a second change lever, associated to each rail, can be actuated in a second direction of movement of the same carriage.

2. The roller rail assembly according to claim 1, wherein the pivoted lever is preloaded so it can keep its two end positions in a stable way.

3. The roller rail assembly according to claim 2, wherein the pivoted lever is preloaded via a spring.

4. The roller rail assembly according to claim 1, wherein the two carriages of a sliding wall element are differently encoded, wherein a switching member disposed at the switching mechanism is configured to be switched by the encoding.

5. A roller rail assembly for a sliding wall, having several sliding wall elements, each sliding wall element supported to be displaceable via two carriages, comprising:

a roller rail;

a branching roller rail; and a turnout that connects the roller rail to the branching roller rail that is switchable by the carriages, wherein, for switching the turnout, at least one carriage of a sliding wall element takes up a position located outside the turnout, wherein the turnout is a switching element connected to a switching mechanism that at least partially protrudes in the travel direction of the carriage travelling on at least one of the roller rail and the branching roller rail, wherein the switching mechanism is actuated by the carriage, whereby the switching element affixed to the switching mechanism moves between the roller rail and the branching roller rail, wherein the two carriages of a sliding wall element are differently encoded, wherein a switching member disposed at the switching mechanism is configured to be switched by the encoding, wherein the two carriages have different mechanical encodings that actuate the switching member configured as a leaf spring, wherein the leaf spring partially surrounds a rotating shaft connecting the pivoted lever and the switching element and one end of the leaf spring at least partially, protrudes into the track of the carriage moving on the roller rail, whereas an other end of the leaf spring extends at least partially into the track of the carriage moving on the branching roller rail.

6. The roller rail assembly according to claim 5, wherein the respective mechanical encoding is by cams affixed to different locations of the two carriages of a sliding wall element.

7. The roller rail assembly according to claim 1, wherein the switching member is a rotary disc, a first rotary disc points in the direction of the roller rail and a second rotary disc points in the direction of the branching roller rail, wherein the first and the second rotary discs, are interconnected via an arm assembly and the rotary discs can be actuated by one or more of several differently located cams of the carriages of a sliding wall element.

8. A method for operating a turnout in a roller rail for a sliding wall having several sliding wall elements each having carriages, the roller rail connected to a branching roller rail via a turnout, wherein, for each of the roller rail and the branching roller rail, two respective switching members are disposed at the pivoted lever, the members are configured as change levers that point into the direction of their respective rail, the method comprising:

displacing in each sliding wall element in the roller rail;

switching the turnout by each carriage, wherein the turnout is switched and subsequently the carriage enters the turnout;

actuating a first change lever associated to each rail in a first direction of movement of the carriage by the carriage; and actuating a second change lever, associated to each rail in a second direction of movement of the same carriage.

9. The method according to claim 8, wherein a leading carriage switches the turnout for a trailing carriage.

10. The method according to claim 8, wherein the carriage switches the turnout before entering the turnout.

* * * * *